US007932457B2

(12) United States Patent
Hall et al.

(10) Patent No.: US 7,932,457 B2
(45) Date of Patent: Apr. 26, 2011

(54) ACCELERATED AGING PROCESS FOR ACOUSTIC STRINGED INSTRUMENTS

(75) Inventors: James Hall, Tampa, FL (US); Daniel P. Hess, Lutz, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 11/668,031

(22) Filed: Jan. 29, 2007

(65) Prior Publication Data

US 2007/0175320 A1 Aug. 2, 2007

Related U.S. Application Data

(60) Provisional application No. 60/763,021, filed on Jan. 27, 2006.

(51) Int. Cl.
*G10H 3/00* (2006.01)

(52) U.S. Cl. ..... 84/723; 84/600; 84/725; 84/726

(58) Field of Classification Search ..... 235/462.44–462.49, 472; 84/726, 84/723, 725, 600
See application file for complete search history.

(56) References Cited

U.S. PATENT DOCUMENTS 1,197,116 A * 9/1916 Floyd ..... 84/294
1,467,576 A 9/1923 Flydal
1,836,089 A * 12/1931 Schweitzer ..... 84/452 R
2,911,872 A 11/1959 Carl
3,194,870 A * 7/1965 Tondreau et al. ..... 84/726
3,656,395 A 4/1972 Kaman
3,774,009 A 11/1973 Hodges
3,824,343 A * 7/1974 Dahlquist ..... 381/335
3,825,666 A * 7/1974 Jaggers ..... 84/672
3,860,086 A 1/1975 Mahajan et al.
4,245,540 A * 1/1981 Groupp ..... 84/726
4,348,552 A * 9/1982 Siccone ..... 381/99
4,387,297 A 6/1983 Swartz et al.
4,496,831 A 1/1985 Swartz et al.
4,538,072 A 8/1985 Immier et al.
4,593,186 A 6/1986 Swartz et al.
4,678,715 A 7/1987 Giebeler et al.
5,023,824 A 6/1991 Chadima et al.
5,031,501 A * 7/1991 Ashworth ..... 84/723
5,067,573 A 11/1991 Uchida
5,168,145 A 12/1992 Tackett et al.
5,198,651 A 3/1993 Barkan et al.
5,410,141 A 4/1995 Koenck et al.
5,416,283 A 5/1995 Dault
5,422,442 A 6/1995 Gouda et al.
5,468,952 A 11/1995 Alexander et al.
5,475,214 A * 12/1995 DeFranco et al. ..... 250/221

(Continued)

OTHER PUBLICATIONS

"Instant Vintage" by Rick Turner, http://web.archive.org/web/20011217060900/http://www.acousticguitar.com/Gear/advice/vibration.shtml.*

*Primary Examiner* — Walter Benson
*Assistant Examiner* — Kawing Chan
(74) *Attorney, Agent, or Firm* — Ronald E. Smith; Smith & Hopen, P.A.

(57) ABSTRACT

A method of artificially aging a musical instrument is provided by placing the instrument in an enclosure, providing at least one electromechanical transducer proximate to the instrument and providing an electrical signal to the transducer. The transducer is a three-way speaker in a preferred embodiment. The method has particular utility wherein the instrument is a wooden, stringed instrument.

21 Claims, 6 Drawing Sheets

U.S. PATENT DOCUMENTS 5,488,575 A 1/1996 Danielson et al.
5,537,908 A * 7/1996 Rabe et al. ..... 84/454
5,600,081 A 2/1997 Simjian
5,600,121 A 2/1997 Kahn et al.
5,612,720 A 3/1997 Ito et al.
5,657,201 A 8/1997 Kochis
5,703,626 A 12/1997 Itoh et al.
5,736,726 A 4/1998 VanHorn et al.
5,744,791 A 4/1998 Isaac et al.
5,763,864 A 6/1998 O'Hagan et al.
5,801,371 A 9/1998 Kahn et al.
5,911,396 A * 6/1999 Bireley ..... 248/340
5,969,328 A * 10/1999 Kunert ..... 235/472.01
6,036,098 A 3/2000 Goldman et al.
6,040,510 A 3/2000 Yaun
6,065,679 A 5/2000 Levie et al.
6,068,307 A 5/2000 Murphy
6,109,528 A 8/2000 Kunert et al.
6,112,993 A 9/2000 Svetal et al.
6,170,748 B1 1/2001 Hash et al.
6,179,135 B1 1/2001 Simpson
6,262,354 B1 * 7/2001 Solomon, Jr. ..... 84/329
6,394,355 B1 5/2002 Schlieffers et al.
6,410,865 B1 6/2002 Liu et al.
6,415,982 B2 7/2002 Bridgelall et al.
6,495,784 B2 12/2002 Yoon et al.
6,497,368 B1 12/2002 Friend et al.
D473,658 S 4/2003 Adams
6,605,765 B1 * 8/2003 Johnson ..... 84/267
6,708,883 B2 3/2004 Krichever
6,722,569 B2 4/2004 Ehrhart et al.
6,822,853 B2 * 11/2004 Wulff et al. ..... 361/680
7,064,745 B2 6/2006 Kim
7,069,061 B2 6/2006 Gammon et al.
7,195,169 B2 * 3/2007 Bhatia et al. ..... 235/472.01
7,227,068 B1 * 6/2007 Van Doren ..... 84/297 R
7,259,310 B2 8/2007 Wilfer
2001/0042681 A1 11/2001 Yoon et al.
2004/0017924 A1 * 1/2004 Kuratani et al. ..... 381/349
2004/0060417 A1 * 4/2004 Janes et al. ..... 84/291
2004/0252851 A1 * 12/2004 Braun ..... 381/101
2004/0255753 A1 12/2004 Wilfer
2005/0000348 A1 * 1/2005 Workman ..... 84/327
2005/0011951 A1 1/2005 Chang et al.
2005/0155481 A1 * 7/2005 Yu ..... 84/327
2005/0252363 A1 * 11/2005 Rockett ..... 84/723
2006/0072768 A1 * 4/2006 Schwartz et al. ..... 381/94.1
2006/0117938 A1 * 6/2006 Gillette ..... 84/723
2007/0175320 A1 8/2007 Hall et al.
2008/0190260 A1 8/2008 Lye
2008/0289483 A1 11/2008 Hall et al.
2009/0229445 A1 * 9/2009 Courtright et al. ..... 84/453
2009/0293707 A1 12/2009 Suhr

* cited by examiner

FIG. 3A $$P_{FF}(f) = \Sigma\,(F(f)\,F(f)^*)\,/\,n\ ,\ P_{AA}(f) = \Sigma\,(A(f)\,A(f)^*)\,/\,n\ ,\ P_{AF}(f) = \Sigma\,(F(f)\,A(f)^*)\,/\,n \quad (1)$$

where * indicates complex conjugate.

FIG. 3B $$FR(f) = \frac{P_{AF}(f)}{P_{FF}(f)} \quad (2)$$

FIG. 3C $$\gamma^2(f) = \frac{P_{AF}(f)\ P_{AF}(f)^*}{P_{FF}(f)\ P_{AA}(f)} \quad (3)$$

ACCELERATED AGING PROCESS FOR ACOUSTIC STRINGED INSTRUMENTS

CROSS REFERENCE TO RELATED APPLICATIONS

This application claims priority to U.S. Provisional Application 60/763,021 filed on Jan. 27, 2006, which is incorporated herein by reference.

BACKGROUND OF THE INVENTION

It is known that stringed instruments are enhanced with age, specifically from actual playing-time (or use). The wood used to construct the instruments provides a more pleasing result the more it is vibrated. It is for this reason that such a high value is placed on vintage instruments.

The vibration associated with use of the instrument causes subtle changes in the pliability of the wood. Vibration has equal effects on the natural resins within the wood. Moreover, finishes such as lacquer, commonly applied to wooden stringed instruments, are effected by vibration resulting in the loss of plasticizers. These changes usually take many years.

Others have sought to shorten the time needed to gain the desired effects of aging. For example, U.S. Pat. No. 2,911,872 describes a motor powered apparatus which mechanically bows the strings of a violin. The system can be set up such that the strings can be played at any selected position and bowed in succession. U.S. Pat. No. 5,031,501 describes a device comprising a small shaker which is attached to the sound board of a stringed instrument. The shaker is then driven by a musical signal to simulate what the sound board experiences as it is being played. These approaches both provide automatic means to simulate playing the instrument, thus allowing the instrument to be aged without the expenditure of time or effort by a real musician. However, both approaches take a prolonged period of time to age a new instrument because they basically simulate playing the instrument; aging occurs in real time.

U.S. Pat. No. 5,537,908 developed a process for wooden stringed instruments that utilizes broadband vibration from a large electromagnetic shaker and controller. The instrument is attached to a specially designed shaker fixture and then subjected to broadband vibration excitation. The broadband input provides excitation over the frequency range of 20 to 2,000 Hz, providing accelerated aging compared to single tone inputs from earlier methods. Experienced musicians attested to hearing improvement in sound producing ability after application of this method. In addition, simple vibration measurements showed an increase in instrument response. The process, however, requires direct contact or coupling with a large electromagnetic shaker which can and result in damage to the instruments processed. In addition, the upper frequency limit of such shakers is about 2,000 Hz.

SUMMARY OF INVENTION

In one embodiment, the invention includes a method of artificially aging an instrument by placing the instrument in an enclosure, providing at least one electromechanical transducer proximate to the instrument and providing an electrical signal to the transducer. The transducer is a three-way speaker in a preferred embodiment. The method has particular utility wherein the instrument is a wooden, stringed instrument.

In an alternate embodiment, wherein the instrument is a wooden, stringed instrument, at least one electromechanical transducer is provided proximate the body of the instrument and another electrochemical transducer is provided proximate the neck of the instrument. This allows excitation of the instrument when a broadband signal is amplified and passed through the transducer.

BRIEF DESCRIPTION OF THE DRAWINGS

For a fuller understanding of the nature and objects of the invention, reference should be made to the following detailed description, taken in connection with the accompanying drawings, in which:

FIG. 3A is the formula for calculating the average power and cross spectra.

FIG. 3B is the formula for computing frequency response.

FIG. 3C is the formula for calculating coherence $\gamma^2(f)$ as a function of frequency.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
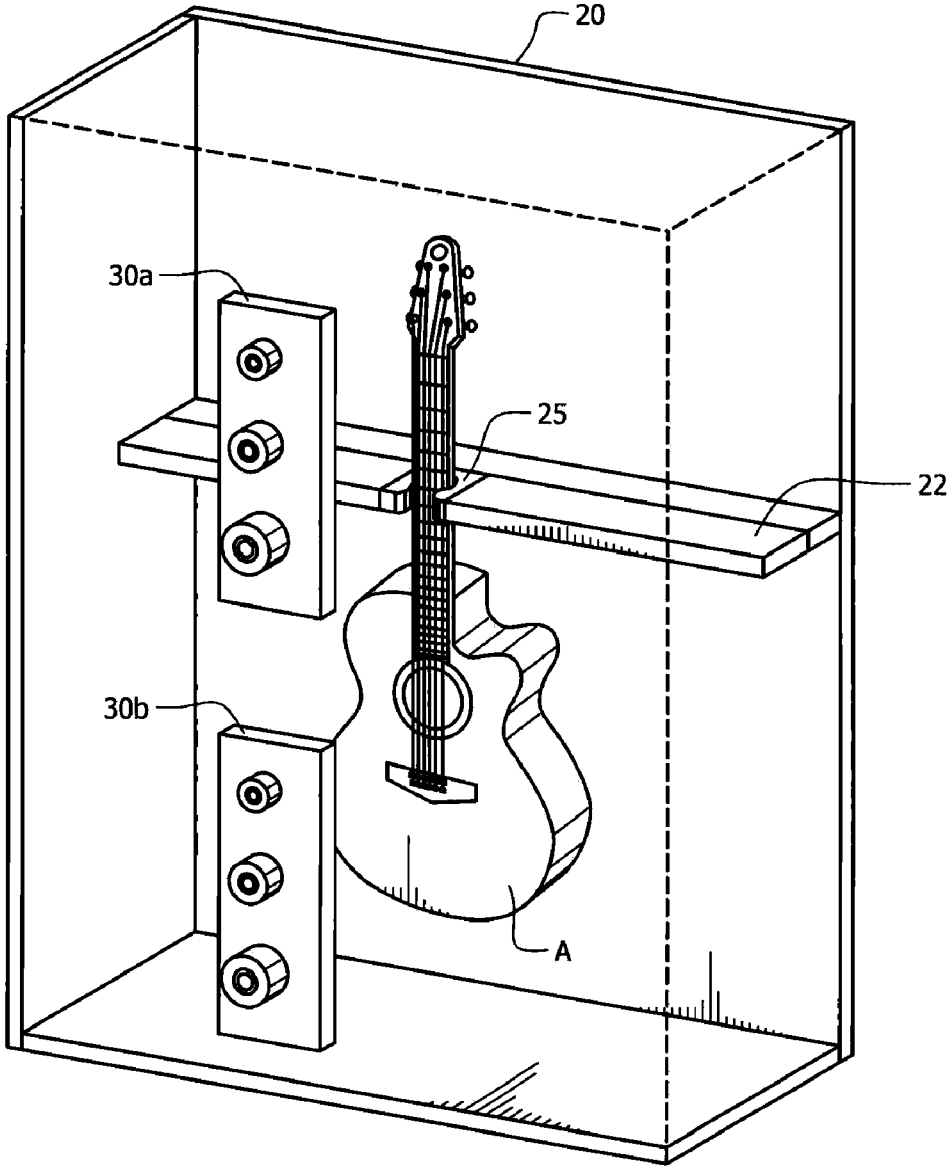
FIG. 1 is a perspective view of an illustrative device for implementing the inventive method.
Figure 2:
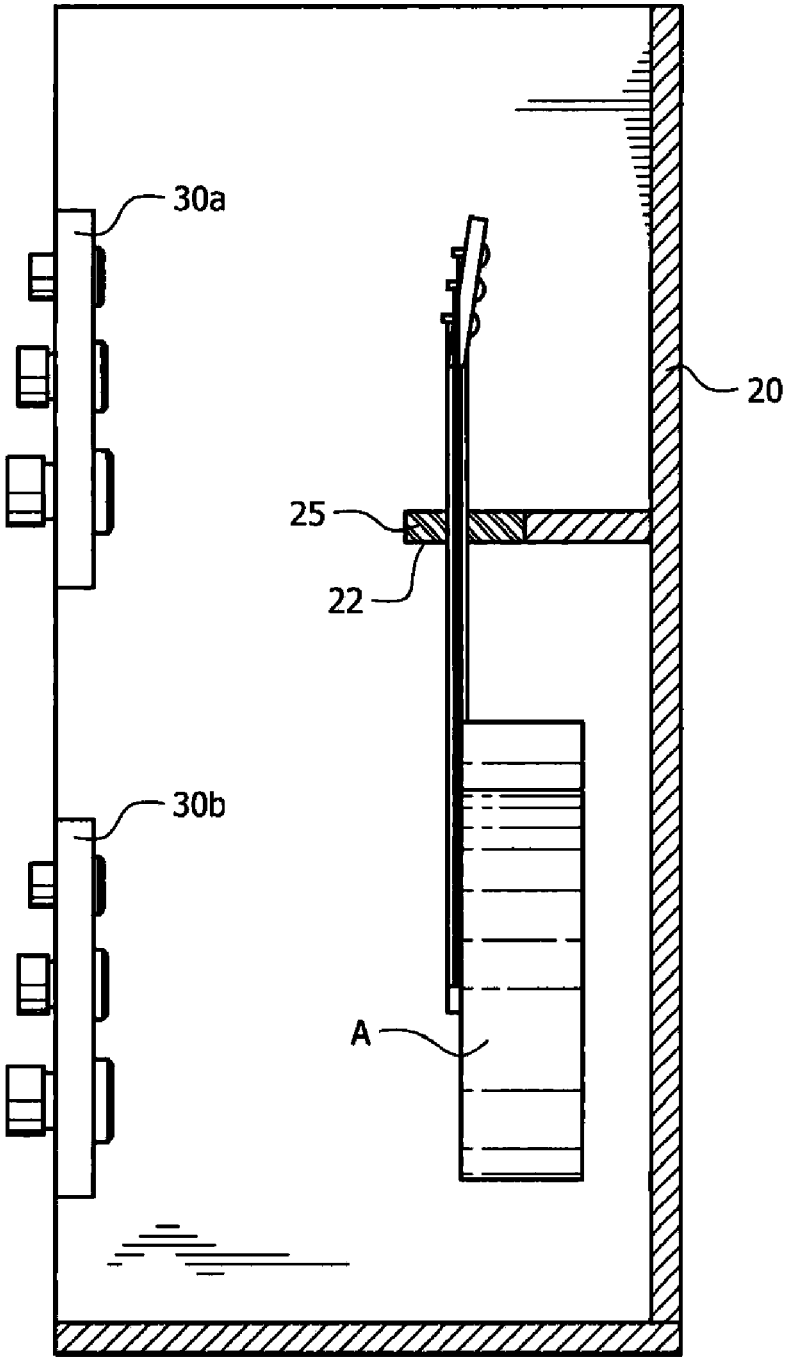
FIG. 2 is a side view of the illustrative device of FIG. 1.

This invention provides a method for the accelerated aging of instruments, particularly wooden stringed instruments, and for quantifying this phenomenon using formal frequency response analyses. The excitation is non-contact and broadband over a more complete frequency range of 20 to 20,000 Hz. An illustrative device for employing the inventive method is disclosed in FIGS. 1 and 2. Instrument A is suspended in enclosure 20. The enclosure can be mobile, resembling a box or case, or can be room specifically adapted for the accelerated aging of multiple instruments or large instruments such as a piano. In FIG. 1, the enclosure (20) is a box (with most of sides omitted for ease of viewing). Instrument A is a guitar suspended in enclosure 20 at the neck by support 22. Padding can be used to isolate instrument A from support 22 and to protect its surface. Enclosure 20 can be constructed from any suitable material, including inexpensive materials such as medium density fiberboard. Electromechanical transducers, such as speakers 30*a* and 30*b*, are positioned to subject instrument A to the sound waves created thereby. In one embodiment, a pair of speakers are utilized with one speaker 30*a* facing the front body of instrument A and the second speaker 30*b* facing the instrument's neck. Speakers 30 are driven with a broadband signal through a power amplifier (not shown). The preferred embodiment is capable of providing broadband sound levels of at least 110 dB without clipping or distortion. The speakers and amplifier are adapted to run continuously for days or weeks at a time.

Test instruments were assessed before and after the acoustic treatment. Experienced musicians provided subjective input on test instruments and found significant improvement with respect to response, playability, and ease of tuning. In addition, frequency response data computed from impact testing using a miniature soft tipped impact hammer and a miniature accelerometer revealed significant improvements in measured response.

Frequency Response

Frequency response, FR(f), is defined with the impact force F (in units of Newtons, N) to the instrument as the input and the resulting vibratory acceleration A (in units of g) of the instrument sound board as the output. It is calculated using a two-channel dynamic signal analyzer as follows. Time trace measurements of the dynamic input and output are obtained, these measurements are windowed, and the fast Fourier transforms of these windowed time traces are computed. This is repeated at least 8 times, and the average power and cross spectra are computed as using equation (1) in FIG. 3A. The frequency response is then computed using equation (2) in FIG. 3B.

The magnitude of the response function is presented graphically in g/N versus frequency. Coherence is also computed to assess the validity of the measurement. Coherence provides a measure of the power in the test instrument vibration that is caused by the power in the impact force. A coherence of 1 means that all of the vibratory acceleration is caused by the impact force, whereas a coherence of 0 means that none of the vibration is caused by the force. The coherence $\gamma^2(f)$ is a function of frequency and is computed using equation (3) (FIG. 3C).

Acoustic Treatment Results

Tests with several sample violins and guitars were performed. The instruments were subjected to the acoustic treatment, as describe above, continuously for several weeks using pink noise broadband input. The instruments were assessed both before and after the treatment by experienced musicians and through frequency response measurements.

The musicians noticed a vast improvement in the tonal quality (warmer), responsiveness (increased response), and ease of tuning. The improved ease in tuning is of special interest because new instruments (especially lower-end string instruments) are very difficult to get and keep in tune.

Figure 4A:
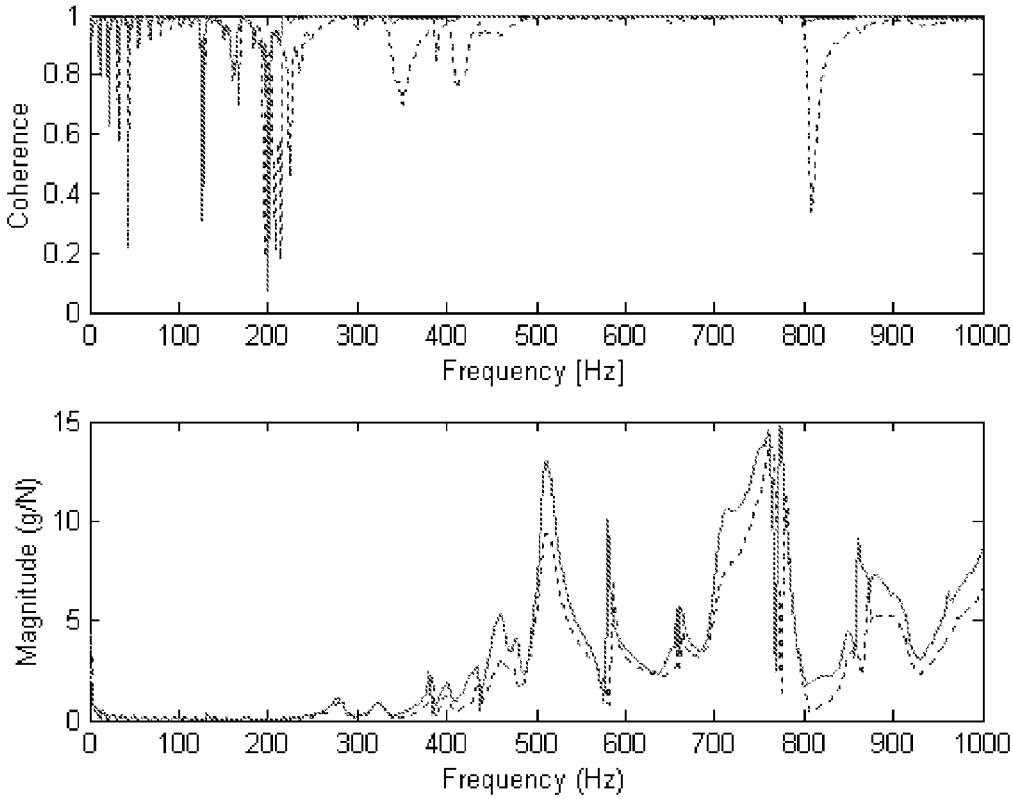
FIG. 4A is a graph showing representative initial and final (i.e., before and after) frequency response data for a sample violin.
Figure 4B:
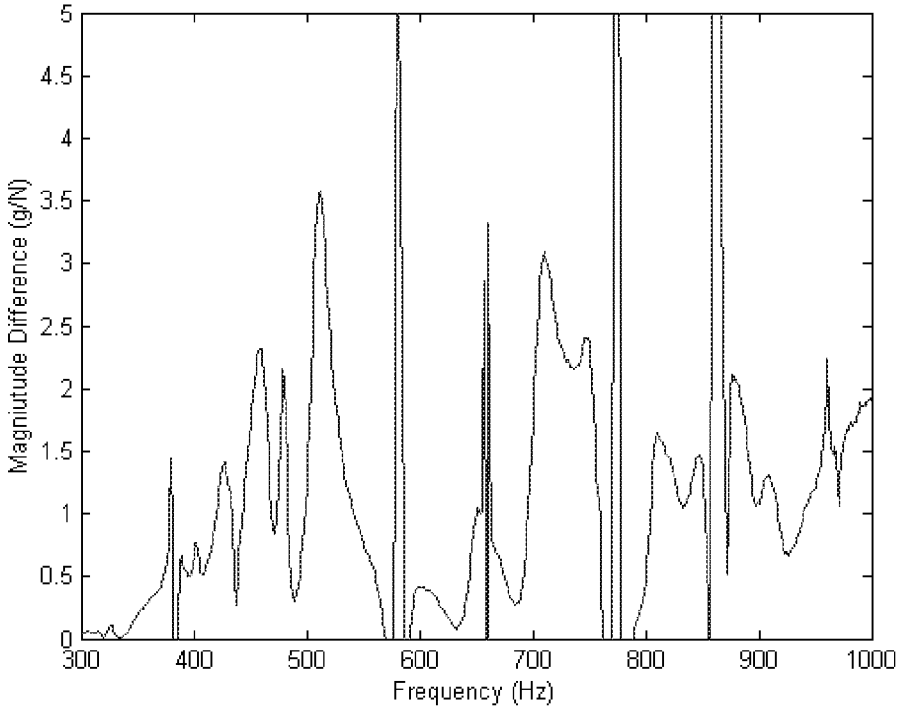
FIG. 4B is a graph showing the change or difference in magnitude after the aging treatment.

FIG. 4A shows representative initial and final (i.e., before and after) frequency response data from a sample violin. The coherence shows that most of the response is due to the input over most of the frequency range assessed. The magnitude is notably higher following the aging treatment. This is highlighted in FIG. 4B which shows the difference in magnitude. This data clearly shows that the instrument yields more vibratory response (g) per unit input (N) over most of the frequency range. This is consistent with one of the findings observed independently from experienced musicians.

Figure 5:
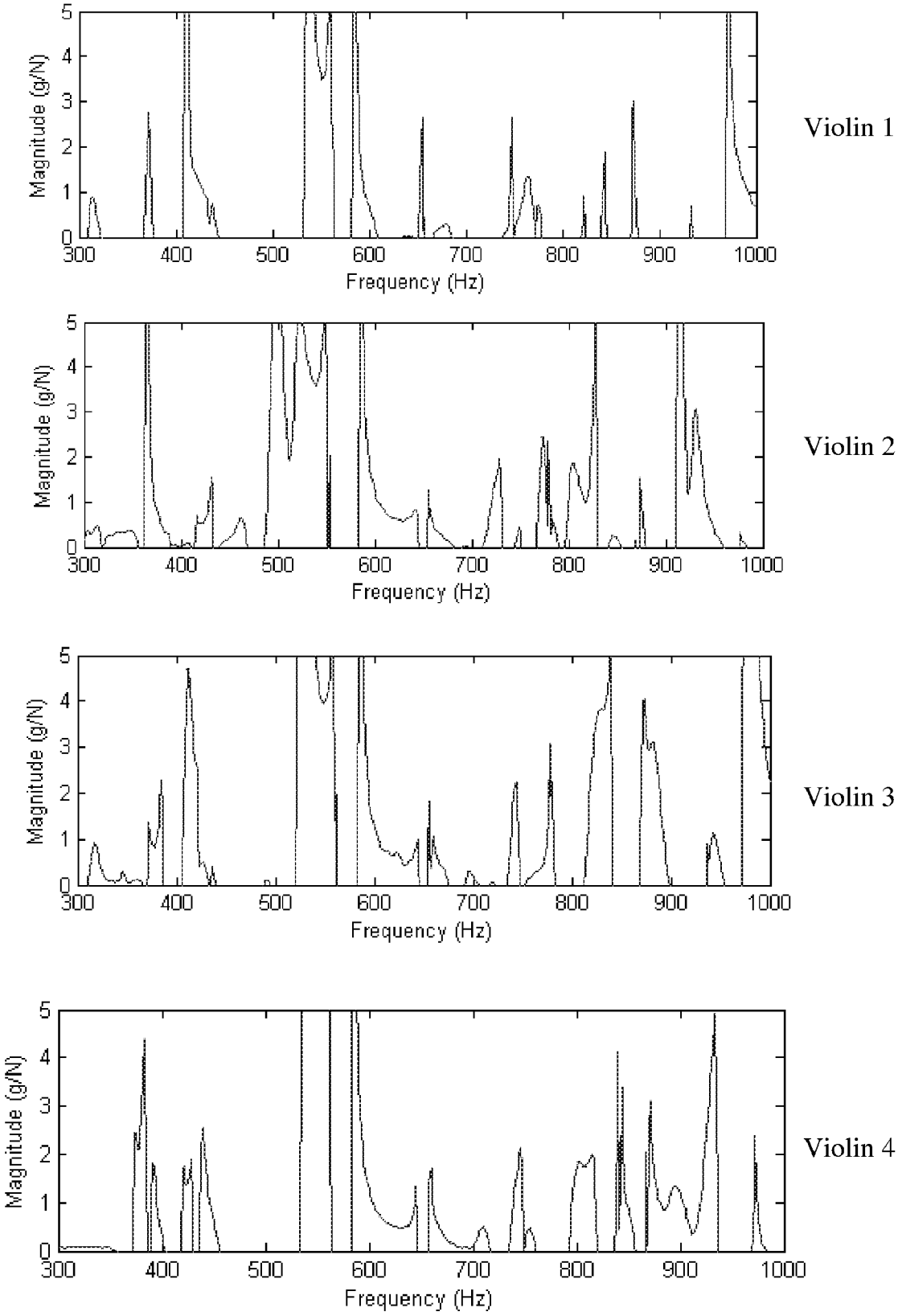
FIG. 5 shows graphs of the change or difference in measured frequency response magnitude after the aging treatment for four additional sample violins.

Additional tests were performed on four additional violins and three guitars. All instruments tested showed an increase in vibratory response. FIG. 5 shows the change or difference in measured frequency response magnitude after aging treatment for four sample violins. A positive magnitude change means that the instruments produce more sound, or responds more for the same energy input; a significant aspect of this process. The violins used for testing ranged in quality from very cheap ($150.00) to moderately priced ($1200.00) with the building quality commensurate with the price paid.

Figure 6:
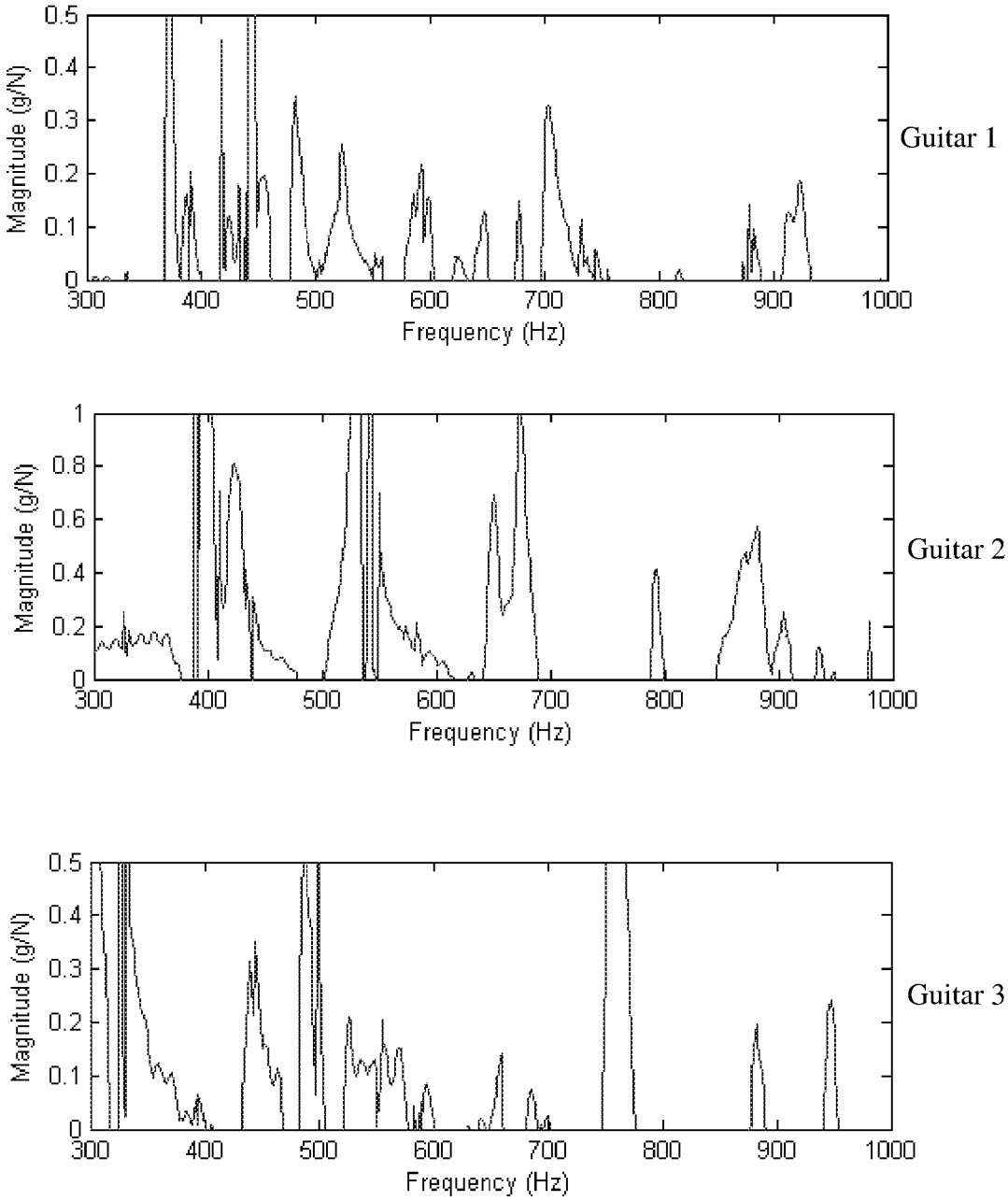
FIG. 6 shows graphs of the change or difference in measured frequency response magnitude after the aging treatment for three sample guitars.

The change in measured frequency response magnitude after the aging treatment for three sample guitars is shown in FIG. 6. Even though the magnitude change is less than observed for the violins, an increase of 0.5 to 1.0 g/N is still significant.

As used herein, the term electromechanical transducer refers to any device that converts one type of energy to another, such as converting electricity into sound waves. In an illustrative embodiment, the electromechanical transducer is a three-way speaker comprising three drivers: large for the bass, midsize for the midrange frequencies, and small for the high frequencies.

As used herein, the term broadband refers to a signaling method which includes or handles a relatively wide range of frequencies, about 20 to 20,000 Hz, which may be divided into channels.

As used herein, the term stringed-instrument refers to any musical instrument that produces sound by means of vibrating strings, such as those in the violin, guitar and piano families.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A method of artificially aging a wooden musical instrument, comprising the steps of:

providing a dynamically dead enclosure dedicated to enclosing a wooden musical instrument, said dynamically dead enclosure having a volume sufficient to enclose only one wooden musical instrument and at least one electromechanical transducer;

providing a dynamically dead support structure within said dynamically dead enclosure from which said wooden musical instrument is suspended;

suspending said wooden musical instrument from said support structure in said enclosure;

positioning said at least one electromechanical transducer in said enclosure and directing said at least one electromechanical transducer toward at least one wooden portion of said wooden musical instrument;

positioning said at least one electromechanical transducer and said wooden musical instrument in spaced apart relation to one another within said enclosure so that said wooden musical instrument hangs freely within said enclosure; and providing a broadband electrical signal in the range of 20 to 20,000 HZ to said at least one electromechanical transducer so that acoustical energy, having a broadband sound level of at least 110 dB, is emitted from said at least one electromechanical transducer to excite all vibrational and acoustical modes of said wooden musical instrument.

2. The method of claim 1, further comprising the steps of:

providing said at least one electromechanical transducer in the form of a speaker.

3. The method of claim 2, further comprising the steps of:
providing said speaker in the form of a three-way speaker.

4. The method of claim 1, further comprising the steps of:
providing said wooden musical instrument in the form of a wooden, stringed instrument.

5. The method of claim 4, further comprising the steps of:
providing said wooden musical instrument in the form of a wooden musical instrument having a neck and a body; and
positioning said at least one electromechanical transducer near the body of the wooden musical instrument so that acoustical sound waves emitted by said at least one electromechanical transducer induce vibrations in said body to the substantial exclusion of other parts of said wooden musical instrument.

6. The method of claim 4, further comprising the steps of:
providing said wooden musical instrument in the form of a wooden musical instrument having a neck and a body; and
positioning said at least one electromechanical transducer near the neck of said wooden musical instrument so that acoustical sound waves emitted by said at least one electromechanical transducer induce vibrations in said neck to the substantial exclusion of other parts of said wooden musical instrument.

7. The method of claim 1, further comprising the steps of:
providing said electrical signal in the form of an amplified electrical signal.

8. The method of claim 1, further comprising the steps of:
said at least one electromechanical transducer emitting acoustical energy having a predetermined spectral content consisting of at least one resonant frequency of said wooden musical instrument.

9. The method of claim 1, further comprising the steps of:
positioning said at least one electromechanical transducer in substantially perpendicular relation to said wooden musical instrument.

10. The method of claim 1, further comprising the steps of:
positioning said at least one electromechanical transducer in substantially parallel relation to said wooden musical instrument.

11. The method of claim 1, further comprising the steps of:
said at least one electromechanical transducer emitting acoustical energy having a predetermined spectral content consisting of at least one discrete frequency.

12. The method of claim 1, further comprising the steps of:
applying the electrical signal to said at least one electromechanical transducer for about 14 days.

13. The method of claim 1, further comprising the steps of:
establishing the frequency response of said wooden musical instrument prior to suspending it in the enclosure; and
establishing the frequency response of said wooden musical instrument after it has been subjected to the acoustical energy from said at least one electromechanical transducer.

14. A device for artificially aging a wooden musical instrument, comprising:
a dynamically dead enclosure dedicated to enclosing said wooden musical instrument, said dynamically dead enclosure having a volume insufficient to enclose more than one wooden musical instrument and at least one electromechanical transducer;
a dynamically dead support structure within said enclosure for suspending said wooden musical instrument;
said at least one electromechanical transducer directed toward at least one wooden portion of said wooden musical instrument when said wooden musical instrument is placed within said enclosure and suspended from said support structure;
said at least one electromechanical transducer positioned in spaced apart relation to said wooden musical instrument when it is suspended from said support structure within said enclosure so that said wooden musical instrument hangs freely within said enclosure; and
a power source providing a broadband electrical signal in the range of 20-20,000 Hz to said at least one electromechanical transducer so that acoustic energy, having a broadband sound level of at least 110 dB, emitted from said at least one electromechanical transducer excites all of the vibrational and acoustical modes of said wooden musical instrument.

15. The device of claim 14, further comprising:
said at least one electromechanical transducer being a speaker.

16. The device of claim 15, further comprising:
said speaker being a three-way speaker.

17. The device of claim 14, further comprising:
said at least one electromechanical transducer being positioned near to a portion of said wooden musical instrument when said musical instrument is placed within said enclosure and suspended from said support structure.

18. The device of claim 14, further comprising:
an amplifier in electrical communication with said electromechanical transducer.

19. The device of claim 14, further comprising:
said at least one electromechanical transducer being positioned in substantially perpendicular relation to said wooden musical instrument when said wooden musical instrument is placed within said enclosure and suspended from said support structure.

20. The device of claim 14, further comprising:
said at least one electromechanical transducer being positioned in substantially parallel relation to said wooden musical instrument when said wooden musical instrument is placed within said enclosure and suspended from said support structure.

21. The device of claim 14, further comprising:
said at least one electromechanical transducer being positioned such that acoustic energy produced by said at least one electromechanical transducer contacts said wooden musical instrument in substantially orthogonal relation thereto.

* * * * *